US009953504B2

(12) United States Patent
Gao et al.

(10) Patent No.: US 9,953,504 B2
(45) Date of Patent: Apr. 24, 2018

(54) FIRE ALARM DEVICE

(71) Applicant: Gulf Security Technology Company Limited, Qinhuangdao (CN)

(72) Inventors: Zhihua Gao, Qinhuangdao (CN); Yanhua Bian, Qinhuangdao (CN); Xuemin Liu, Qinhuangdao (CN)

(73) Assignee: GULF SECURITY TECHNOLOGY COMPANY LIMITED, Qinhuangdao (CN)

( * ) Notice: Subject to any disclaimer, the term of this patent is extended or adjusted under 35 U.S.C. 154(b) by 0 days.

(21) Appl. No.: 15/274,607

(22) Filed: Sep. 23, 2016

(65) Prior Publication Data

US 2017/0092091 A1 Mar. 30, 2017

(30) Foreign Application Priority Data

Sep. 25, 2015 (CN) ..... 2015 2 0750369 U

(51) Int. Cl.
*G08B 25/12* (2006.01)
*G08B 17/00* (2006.01)

(52) U.S. Cl.
CPC ..... *G08B 17/00* (2013.01); *G08B 25/12* (2013.01)

(58) Field of Classification Search
CPC .. G08B 17/00; G08B 25/12; H01H 2003/308; H01H 3/022; H01H 2003/0246; H01H 2003/024; H01H 13/62; H01H 17/18; H01H 17/20; H01H 17/22; H01H 13/186
See application file for complete search history.

(56) References Cited

U.S. PATENT DOCUMENTS 3,767,881 A * 10/1973 Sharples ..... H01H 13/186 200/332
3,967,086 A * 6/1976 Bauer ..... H01H 13/52 200/325

(Continued)

FOREIGN PATENT DOCUMENTS

GB 1574703 A 9/1980
GB 2352332 A 1/2001

(Continued)

OTHER PUBLICATIONS

European Search Report for application EP 16190398.4, dated Mar. 7, 2017, 10 pgs.

*Primary Examiner* — Nay Tun
(74) *Attorney, Agent, or Firm* — Cantor Colburn LLP

(57) ABSTRACT

A fire alarm device includes: a base portion; a press portion capable of moving relative to the base portion to deviate away from the base portion or close to the base portion; an alarm switch capable of moving relative to an alarm circuit, to control turn-on and turn-off of the alarm circuit; and a plurality of buttons mounted on the base portion and capable of converting movement of the press portion to movement of the alarm switch; wherein the device has an alarm enable position, wherein, the press portion deviates close to the base portion, to press the plurality of buttons and indirectly press the alarm switch to turn on the alarm circuit; and an alarm disable position, wherein, the press portion deviates away from the base portion, to release the plurality of buttons and indirectly release the alarm switch to turn off the alarm circuit.

20 Claims, 1 Drawing Sheet

(56) References Cited

U.S. PATENT DOCUMENTS

| | | | | | |
|---|---|---|---|---|---|
| 4,902,863 | A * | 2/1990 | Fukuma | H01H 13/28 | 200/445 |
| 5,332,878 | A * | 7/1994 | Borst | H01H 13/20 | 200/329 |
| 6,072,131 | A * | 6/2000 | Dorey | H01H 3/04 | 200/1 B |
| 2006/0207074 | A1* | 9/2006 | Takao | B60R 22/48 | 24/633 |
| 2009/0183977 | A1* | 7/2009 | Chang | H01H 1/10 | 200/513 |
| 2014/0216911 | A1* | 8/2014 | Benni | H01H 3/022 | 200/534 |
| 2014/0284195 | A1* | 9/2014 | Fujita | H01H 13/14 | 200/536 |
| 2015/0001056 | A1* | 1/2015 | Colonna | H01H 23/02 | 200/335 |
| 2015/0068879 | A1* | 3/2015 | Green | H01H 13/42 | 200/468 |

FOREIGN PATENT DOCUMENTS

| | | | |
|---|---|---|---|
| GB | 2424764 | A | 10/2006 |
| GB | 2430554 | A | 3/2007 |

* cited by examiner

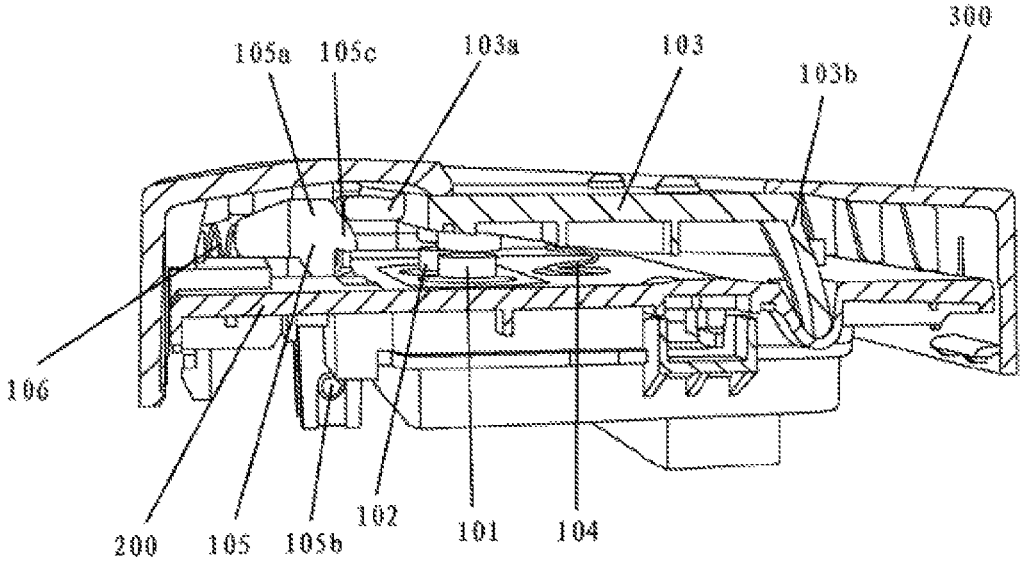
300
105a
105c
103a
103
103b
106
200
105
105b
102
101
104

FIRE ALARM DEVICE

PRIORITY

This application claims priority to Chinese Patent Application No. 201520750369.4, filed Sep. 25, 2015, and all the benefits accruing therefrom under 35 U.S.C. § 119, the contents of which in its entirety are herein incorporated by reference.

TECHNICAL FIELD

The present utility model relates to the field of firefighting security protection equipment, and more particularly, the present utility model relates to a fire alarm device.

RELATED ART

A fire alarm device is a common alarm equipment in the field of firefighting, which is mainly used for warning on-site and surrounding people after a fire is found, to enable relevant personnel to achieve a fire alarm function at the beginning of the fire. A conventional fire alarm device has a housing which is internally provided with a base portion for connecting a mounting environment and supporting various internal parts, an alarm circuit is arranged on one side of the base portion close to a mounting wall, and a button assembly is arranged on one side of the base portion close to the housing. When any relevant personnel finds the fire, he/she can press the button assembly through an opening on the housing and indirectly press an alarm switch through the button assembly to turn on the alarm circuit, so as to achieve the fire alarm function.

Based on an application scenario of the fire alarm device and seriousness of the alarm function, the device should be required to have higher reliability and stronger environment adaptability. However, the existing fire alarm device cannot satisfy the requirements well.

The reasons are as follows: firstly, the existing fire alarm device usually has only one button, and an alarm cannot be triggered once the button fails; secondly, according to the existing production manner, the button and a junction between the button and the base portion are not waterproof, so that an internal alarm circuit is prone to water vapor corrosion. This will result in that the fire alarm device is extremely easy to break down when operating in high humidity environments, and even fails.

SUMMARY

An objective of the present utility model is to provide a fire alarm device, making it have higher reliability and environment adaptability.

To achieve the aforementioned objectives or other objectives, the present utility model provides the following technical solutions.

According to one aspect of the present utility model, a fire alarm device is provided, which includes: a base portion; a press portion which is capable of moving relative to the base portion to deviate away from the base portion or close to the base portion; an alarm switch which is capable of moving relative to an alarm circuit, to control turn-on and turn-off of the alarm circuit; and a plurality of buttons which are mounted on the base portion and capable of converting movement of the press portion to movement of the alarm switch; wherein the device has an alarm enable position, wherein, at this point, the press portion deviates close to the base portion, to press the plurality of buttons and indirectly press the alarm switch to turn on the alarm circuit; and an alarm disable position, wherein, at this point, the press portion deviates away from the base portion, to release the plurality of buttons and indirectly release the alarm switch to turn off the alarm circuit.

According to another aspect of the present utility model, a fire alarm device is further provided, which includes: a base portion; a press portion which is capable of moving relative to the base portion to deviate close to the base portion; an alarm switch which is capable of moving relative to an alarm circuit, to control turn-on of the alarm circuit; and a plurality of buttons which are mounted on the base portion and capable of converting movement of the press portion to movement of the alarm switch; wherein the device has an alarm enable position, and at this point, the press portion deviates close to the base portion, to press the plurality of buttons and indirectly press the alarm switch to turn on the alarm circuit.

BRIEF DESCRIPTION OF THE DRAWINGS

FIG. 1 is a schematic diagram of an embodiment of a fire alarm device according to the present utility model.

DETAILED DESCRIPTION

Referring to FIG. 1, an embodiment of a fire alarm device according to the present utility model is provided. The fire alarm device includes a base portion 200, which can be fixed to a wall or in other actual application environments, and one side of the base portion 200 facing a mounting wall is internally provided with an alarm circuit.

One side of the base portion 200 back to the mounting wall is provided with a press portion 103. A second end 103*b* of the press portion 103 has a pivot which can be inserted into a groove in the base portion 200 and pivotally connected therewith, so as to enable a first end 103*a* of the press portion 103 to deviate away from the base portion 200 or close to the base portion 200.

In addition, it is also feasible to mount a first button 101 and a second button 102 on the base portion 200 through a surface mounting technology, which greatly increases water resistance of the device. Also, alarm switches (not shown) are correspondingly disposed below the buttons, so that they can be activated respectively to turn on the alarm circuit when the first button 101 and the second button 102 are pressed down; and they can be activated respectively to turn off the alarm circuit when the first button 101 and the second button 102 are released. Therefore, as long as one of the first button 101 and the second button 102 can work normally, normal operation of the fire alarm device can be ensured, which thus improves reliability of the device.

Preferably, the first button 101 and the second button 102 are arranged close to the first end 103*a* of the press portion 103 on the base portion 200, so that a greater torque can be applied to the first button 101 and the second button 102 when the press portion 103 is pressed down, so as to ensure that the buttons can be pressed down stably. Also preferably, the first button 101 and the second button 102 may be arranged in parallel to a pivot axis of the press portion 103, which enables the torque to be applied to the two buttons more evenly, so that both buttons present basically the same pressed degrees.

It can be known according to the working principle of the conventional fire alarm device that the fire alarm device should have two working states, i.e., alarm enable and alarm disable. In other words, the alarm circuit should have two states, i.e., turn-on and turn-off. Position or connection relationships between various components and parts should also change with switch of the two states. Therefore, for ease of description, it is considered in the present utility model that the fire alarm device has an alarm enable position and an alarm disable position. When the device is in the alarm enable position, the press portion 103 pivots close to the base portion 200, the first end 103*a* rotates counterclockwise to press the first button 101 and the second button 102 and indirectly presses the alarm switch to turn on the alarm circuit through the first button 101 and the second button 102; when the device is in the alarm disable position, the press portion 103 pivots away from the base portion 200, the first end 103*a* rotates clockwise to release the first button 101 and the second button 102 and indirectly releases the alarm switch to turn off the alarm circuit through the first button 101 and the second button 102.

In addition, to make the fire alarm device reusable, the present utility model further provides a mechanism that can reset all of the press portion, the buttons linked therewith and the alarm switch. In the embodiment of FIG. 1, the mechanism is manifested as a first rebound portion 104. The first rebound portion 104 is supported between the press portion 103 and the base portion 200. Specifically, to ensure firmness of the location thereof, it is feasible to cut a locating slot on the base portion 200, insert one end of the first rebound portion 104 into the locating slot and make the other end of the first rebound portion 104 abut against the press portion 103. When the press portion 103 is in the alarm disable position, the first rebound portion 104 is in a non-compressed rebound state, that is, the first rebound portion 104 at this point does not need to store energy; when the press portion 103 is in the alarm enable position, the first rebound portion 104 is in a compression state, that is, the first rebound portion 104 at this point stores some energy via compression, which has capability of returning the press portion 103 to the alarm disable position.

As shown in FIG. 1, more preferably, the first rebound portion 104 here is supported between the middle of the press portion 103 and the middle of the base portion 200. Such setting is intended to match arrangement of other components and parts such as the buttons, and a position close to the first end 103*a* of the press portion 103 which is subject to the maximum torque is given to the two buttons, so that the buttons can be pressed more easily.

Moreover, to enable the fire alarm device to remain in an alarm working state after press-down, the fire alarm device of the present utility model further includes: a limit portion 105 and a second rebound portion 106. A second end 105*b* of the limit portion 105 is mounted on the base portion 200 and is capable of pivoting relative to the base portion 200, and a first end 105*a* of the limit portion 105 has a hook 105*c* that locks the first end 103*a* of the press portion 103; and the second rebound portion 106 is used for supporting the limit portion 105. During operation, when the device is in the alarm enable position, the second rebound portion 106 is in a compression state, and the hook 105*c* of the limit portion 105 locks the first end 103*a* of the press portion 103; and when the device is in the alarm disable position, the second rebound portion 106 is in a rebound state, and the hook 105*c* of the limit portion 105 releases the first end 103*a* of the press portion 103.

Optionally, the present utility model further provides an implementation manner of buttons 101 and 102. The buttons are elastic bowl-shaped structures, and inner side bottoms of the bowl-shaped structures are provided with bumps; and opening portions of the bowl-shaped structures are mounted on the base portion; wherein, outer side bottoms of the bowl-shaped structures of the buttons, when pressed, will elastically deform and make the bumps contact the alarm switch and press the alarm switch to turn on the alarm circuit. If a user overstrains due to a nervous situation, the bumps may also provide cushioning to some extent due to their own elasticity, to avoid damaging the alarm device and further improve reliability of the device.

Finally, to play a role of protecting the entire device, it is also feasible to dispose a housing 300 outside the device, on which an opening for the user to directly touch the press portion can be provided. At this point, to optimize the structural design, it is also feasible to support the second rebound portion between the housing 300 and the first end 105*a* of the limit portion 105.

Next, the working process of the fire alarm device is described with reference to the embodiment shown in FIG. 1.

When finding a fire, the user runs to the fire alarm device and pushes the press portion 103 with hands, and the first end 103*a* of the press portion makes pivotal movement under a force, which, on the one hand, pushes the first end 105*a* of the limit portion 105, making the limit portion 105 compress the second rebound portion 106, and the second rebound portion stores energy; when the press portion 103 moves beyond the hook 105*c* of the limit portion 105, the hook 105*c* locks the press portion 103; the first end 103*a* of the press portion, on the other hand, pushes the first button 101 and the second button 102 downwards, making them overcome the resistance of the first rebound portion 104 to move (at this point, the first rebound portion 104 stores energy), and pushes the alarm switches arranged below the buttons, thus making the alarm switches turn on the alarm circuit to give an alarm to evacuate people.

After a fire hazard has been eliminated, the user comes to the front of the fire alarm device and makes the second rebound portion 106 to drive the limit portion 105 to move back slightly through a key or in other manners; at this point, the first end 103*a* of the press portion is no longer restricted by the hook 105*c* on the limit portion 105, and the energy stored by the first rebound portion 104 is released, so as to push the press portion 103 to pivot upwards to reset. Afterwards, the second rebound portion 106 and the limit portion 105 can also pivot to reset.

An embodiment of the present utility model is described as above with reference to FIG. 1. However, according to the teachings about the structure and the working principle in the above embodiments, persons skilled in the art can also make several modifications without departing from the conceived scope of the present utility model.

For example, in another circumstance, the fire alarm device is a disposable product. Therefore, it is unnecessary to consider the design of a rebound mechanism, which will help to reduce the number of the parts and arrange the space, thus simplifying the structure of the device and reducing the cost. For this circumstance, the present utility model also provides an embodiment.

At this point, the fire alarm device is substantially the same as that in the embodiment shown in FIG. 1 in terms of some structural design. The fire alarm device should also include a base portion that can be fixed to a wall or in other actual application environments, and one side of the base portion facing a mounting wall is internally provided with an alarm circuit. One side of the base portion back to the mounting wall is provided with a press portion. A second end of the press portion has a pivot, which can be inserted into a groove in the base portion and pivotally connected therewith, so that a first end of the press portion can deviate close to the base portion. In addition, a first button and a second button are mounted on the base portion through a surface mounting technology, which greatly increases water resistance of the device. Also, alarm switches are correspondingly disposed below the buttons, so that they can be activated respectively to turn on the alarm circuit when the first button and the second button are pressed down. Therefore, as long as one of the first button and the second button can work normally, normal operation of the fire alarm device can be ensured, which thus improves reliability of the device.

However, the difference lies in that the press portion in this embodiment does not need to be designed to deviate away from the base portion, and thus the fire alarm device in this embodiment does not need to include a mechanism or part that drives the press portion to deviate away from the base portion either.

The fire alarm device at this point only has a working state of alarm enable, and when the working state is not enabled, the fire alarm device may be in an initial state. In other words, the alarm circuit is in a turn-off state only in the initial state, while it remains in a turn-on state after action trigger. Therefore, for ease of description, it is considered in the present utility model that the fire alarm device only has an alarm enable position. When the device is in the alarm enable position, the press portion pivots close to the base portion, the first end thereof rotates counterclockwise to press the first button and the second button and indirectly press the alarm switch to turn on the alarm circuit through the first button and the second button, so as to give a warning to evacuate people.

Compared with the first embodiment of the present utility model, this embodiment also reduces the manufacturing cost of a single fire alarm device while achieving improvement of reliability of the fire alarm device. However, the fire alarm device cannot be reusable. Therefore, the fire alarm device in which embodiment to be specifically used can be selected according to an actual application situation.

Optionally, on the premise of ensuring that the above main solution of the fire alarm device is achieved, it is also feasible to optimize or modify other structures of the above embodiments.

For example, the arrangement of two buttons described in the above embodiments can be replaced with arrangement of a plurality of buttons, which also achieves an effect of enabling an alarm as long as any button works. However, in consideration of the size of an actual application space, the arrangement of two buttons is employed in the above embodiments. For other alarm devices with enough space, the arrangement of a plurality of buttons is also feasible.

For another example, the press portion used in the above embodiments employs a pivotal movement manner, which can also be replaced with other movement manners. As an alternative, the press portion can be configured to reciprocate along a direction perpendicular to the base portion, which is also applicable to the concept of the present utility model without affecting the solving of the core technical problem. Specifically, when the device is in the alarm enable position, the press portion is vertically pressed downwards to be close to the base portion, making the whole press portion uniformly press the first button and the second button downwards and indirectly press the alarm switch to turn on the alarm circuit through the first button and the second button; when the device is in the alarm disable position, the entire press portion vertically moves upwards to be away from the base portion, so as to release the first button and the second button and indirectly release the alarm switch to turn off the alarm circuit through the first button and the second button.

Therefore, such a movement manner can be applied to the present utility model more easily under the teaching of the present application as long as the movement manner can make the press portion move relative to the base portion and achieve an effect of deviating the press portion to be away from the base portion or close to the base portion.

The above teaching is also applicable to the modification of the movement manner of the limit portion described in the present utility model. The limit portion used in the above embodiment employs a pivotal movement manner, which may also be replaced with other movement manners, for example, a reciprocating manner along a straight line. If such a movement manner is employed, the limit portion will go back along the straight line and advance along the straight line when pressed by the press portion. This can also achieve the limit function thereof conveniently.

In addition, based on several general concepts herein, persons skilled in the art can easily acquire several corresponding specific features, which are thus not repeated herein one by one. For example, a spring or other parts having a rebound property can be employed for the first rebound portion and the second rebound portion herein. Also, the limit portion in the present utility model may have different hook or bayonet forms, or employ other limit parts.

In the description of the present utility model, it should be understood that direction or position relationships indicated by the terms "up", "down", "front", "back", "left", "right" and the like are direction or position relationships shown based on the accompanying drawings, which are merely intended to make it easy to describe the present utility model and simplify the description, instead of indicating or implying that the device or feature indicated has to have a particular direction and to be constructed or operated with the particular direction, and thus cannot be construed as limitations to the present utility model.

The examples described above mainly describe the fire alarm device of the present utility model. Although only some implementation manners of the present utility model are described, persons of ordinary skill in the art should understand that, the present utility model may be implemented in many other manners without departing from the gist and scope of the present utility model. Therefore, the examples and implementation manners illustrated are construed as schematic rather than restrictive, and the present utility model may cover various modifications and replacements without departing from the spirit and scope of the present utility model as defined by the appended claims.

The invention claimed is:

1. A fire alarm device, comprising:

a base portion;

a press portion configured to move relative to the base portion to deviate away from the base portion or close to the base portion;

an alarm switch configured to move relative to an alarm circuit, to control turn-on and turn-off of the alarm circuit;

a plurality of buttons which are mounted on the base portion and configured to convert movement of the press portion to movement of the alarm switch;

a limit portion which is mounted on the base portion and configured to move relative to the base portion; and a first rebound portion which supports the limit portion;

wherein the device has an alarm enable position, wherein in the alarm enable position, the press portion deviates close to the base portion, to press the plurality of buttons and indirectly press the alarm switch to turn on the alarm circuit;

wherein the device has an alarm disable position, wherein in the alarm disable position, the press portion deviates away from the base portion, to release the plurality of buttons and indirectly release the alarm switch to turn off the alarm circuit;

wherein a second end of the press portion is configured to pivot relative to the base portion, to enable a first end of the press portion to deviate away from the base portion or close to the base portion; and wherein, when the device is in the alarm enable position, the first rebound portion is in a compression state, and the limit portion locks the first end of the press portion.

2. The fire alarm device according to claim 1, wherein the plurality of buttons are arranged on the first end of the press portion.

3. The fire alarm device according to claim 1, wherein the plurality of buttons are arranged in parallel to a pivot axis of the press portion.

4. The fire alarm device according to claim 1, wherein the number of the plurality of buttons is two.

5. The fire alarm device according to claim 1, wherein the press portion is configured to vertically reciprocate relative to the base portion, to make the press portion reciprocate away from the base portion or close to the base portion.

6. The fire alarm device according to claim 1, further comprising:

a second rebound portion which is supported between the press portion and the base portion;

wherein, when the device is in the alarm enable position, the second rebound portion is in a compression state; and when the device is in the alarm disable position, the second rebound portion is in a rebound state.

7. The fire alarm device according to claim 6, wherein the second rebound portion is supported between the middle of the press portion and the middle of the base portion.

8. The fire alarm device according to claim 6, wherein the middle of the base portion is provided with a locating slot for accommodating the second rebound portion.

9. The fire alarm device according to claim 1, wherein: when the device is in the alarm disable position, the first rebound portion is in a rebound state, and the limit portion releases the first end of the press portion.

10. The fire alarm device according to claim 1, wherein a second end of the limit portion is configured to pivot relative to the base portion, and/or a first end of the limit portion has a hook that locks the first end of the press portion.

11. The fire alarm device according to claim 10, further comprising a housing covering the base portion externally, the first rebound portion being supported between the housing and the first end of the limit portion.

12. The fire alarm device according to claim 1, wherein the plurality of buttons are connected to the base portion through surface mounting.

13. The fire alarm device according to claim 1, wherein the buttons are elastic bowl-shaped structures, and inner side bottoms of the bowl-shaped structures are provided with bumps; and opening portions of the bowl-shaped structures are mounted on the base portion;

wherein, when the device is in the alarm enable position, the press portion deviates to press outer side bottoms of the bowl-shaped structures, to make the bowl-shaped structures elastically deform and make the bumps contact the alarm switch and press the alarm switch to turn on the alarm circuit; and when the device is in the alarm disable position, the press portion deviates to leave the outer side bottoms of the bowl-shaped structures, to make the bowl-shaped structures recover from an elastic deformation state and make the bumps leave the alarm switch and release the alarm switch to turn off the alarm circuit.

14. A fire alarm device, comprising:

a base portion;

a press portion which is configured to move relative to the base portion to deviate close to the base portion;

an alarm switch which is configured to move relative to an alarm circuit, to control turn-on of the alarm circuit;

a plurality of buttons which are mounted on the base portion and configured to convert movement of the press portion to movement of the alarm switch;

a limit portion which is mounted on the base portion and configured to move relative to the base portion; and a rebound portion which supports the limit portion;

wherein the device has an alarm enable position, wherein in the alarm enable position, the press portion deviates close to the base portion, to press the plurality of buttons and indirectly press the alarm switch to turn on the alarm circuit;

wherein a second end of the press portion is configured to pivot relative to the base portion, to enable a first end of the press portion to deviate close to the base portion; and wherein, when the device is in the alarm enable position, the rebound portion is in a compression state, and the limit portion locks the first end of the press portion.

15. The fire alarm device according to claim 14, wherein the plurality of buttons are arranged on the first end of the press portion.

16. The fire alarm device according to claim 14, wherein the plurality of buttons are arranged in parallel to a pivot axis of the press portion.

17. The fire alarm device according to claim 14, wherein the number of the plurality of buttons is two.

18. The fire alarm device according to claim 14, wherein the press portion is configured to vertically reciprocate relative to the base portion, to enable the press portion reciprocate close to the base portion.

19. The fire alarm device according to claim 14, wherein the plurality of buttons are connected to the base portion through surface mounting.

20. The fire alarm device according to claim 14, wherein the buttons are elastic bowl-shaped structures, and inner side bottoms of the bowl-shaped structures are provided with bumps; and opening portions of the bowl-shaped structures are mounted on the base portion;

wherein, when the device is in the alarm enable position, the press portion deviates to press outer side bottoms of the bowl-shaped structures, to make the bowl-shaped structures elastically deform and make the bumps contact the alarm switch and press the alarm switch to turn on the alarm circuit.

* * * * *